US007780267B2

(12) United States Patent
Iijima

(10) Patent No.: US 7,780,267 B2
(45) Date of Patent: Aug. 24, 2010

(54) RECORDING HEAD FOR INK-JET RECORDING APPARATUS

(75) Inventor: Yasushi Iijima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 507 days.

(21) Appl. No.: 11/846,443

(22) Filed: Aug. 28, 2007

(65) Prior Publication Data

US 2008/0266359 A1 Oct. 30, 2008

(30) Foreign Application Priority Data

Aug. 29, 2006 (JP) ..... 2006-232472

(51) Int. Cl.
*B41J 2/135* (2006.01)

(52) U.S. Cl. ..... 347/54; 347/44; 347/56; 347/65

(58) Field of Classification Search ..... 347/20, 347/44, 47, 54, 56, 61–65, 67, 68, 70–71, 347/92–94

See application file for complete search history.

(56) References Cited

U.S. PATENT DOCUMENTS

| | | | | | |
|---|---|---|---|---|---|
| 4,962,391 | A * | 10/1990 | Kitahara et al. | ..... | 347/47 |
| 6,439,701 | B1 * | 8/2002 | Taneya et al. | ..... | 347/65 |
| 6,598,960 | B1 | 7/2003 | Cabal | | |
| 6,685,303 | B1 * | 2/2004 | Trauernicht et al. | ..... | 347/54 |
| 2003/0137560 | A1 | 7/2003 | Lebens | | |
| 2004/0036739 | A1 | 2/2004 | Delametter | | |

FOREIGN PATENT DOCUMENTS

| | | | | | |
|---|---|---|---|---|---|
| JP | 2-4517 | * | 1/1990 | ..... | 347/68 |

* cited by examiner

*Primary Examiner*—Juanita D Stephens
(74) *Attorney, Agent, or Firm*—Canon U.S.A., Inc. I.P. Division

(57) ABSTRACT

A recording head configured to discharge ink from a nozzle includes a cantilever and a liquid chamber. The cantilever has a free end and a fixed end and bends to generate a pressure for discharging ink. The liquid chamber communicates with the nozzle. The cantilever is disposed in the liquid chamber. The cantilever has a stepped portion on or in a surface facing the nozzle and in the vicinity of the free end.

1 Claim, 6 Drawing Sheets

RECORDING HEAD FOR INK-JET RECORDING APPARATUS

BACKGROUND OF THE INVENTION

1. Field of the Invention

The present invention relates to a recording head, and more specifically, it relates to an ink-jet recording head that discharges ink with a thermo-mechanical actuator to perform recording.

2. Description of the Related Art

Recording heads of ink-jet recording apparatuses use various methods for discharging ink. For example, a method in which thermal energy is applied on ink to generate a bubble and a method using a piezo element as an electro-mechanical actuator have been known and put to practical use. In addition, in recent years, the development of a method using a thermo-mechanical actuator has been advanced because the method affords greater manufacturability and flexibility in ink composition.

U.S. Pat. Appl. Pub. No. 2003/0137560 discloses a recording head using a cantilevered thermo-mechanical actuator including two layers, a heating layer and a dielectric material layer. An example of such a thermo-mechanical actuator will be briefly described with reference to FIGS. 5A to 5C.

FIG. 5A is a top plan view of a discharging portion of a recording head (the term "top plan view" refers to a view from the direction in which an ink droplet is discharged). FIG. 5B is a sectional view taken along line VB-VB of FIG. 5A. FIG. 5C illustrates a state in which a droplet is being discharged from the discharging portion shown in FIGS. 5A and 5B.

As shown in FIGS. 5A to 5B, a liquid chamber 2 is formed above a silicon substrate 1, and an ink droplet is discharged from a nozzle 3. A cantilever 4 serving as a thermo-mechanical actuator is formed in the liquid chamber 2. The cantilever 4 includes a heating layer 20, a conductor layer, and a dielectric material layer 21. The heating layer 20 is divided into two heating portions by a slit. The conductor layer forms an interconnect portion 5 (5*a* and 5*b*) that supplies current to the two heating portions, and an electrode 11 that connects the two heating portions. First, the heating layer 20 is formed. The conductor layer is superposed on the heating layer 20. Finally, the dielectric material layer 21 is superposed on the heating layer 20 and the conductive layer. In this way, the cantilever 4 is formed. The linear expansion coefficient of the dielectric material layer 21 is smaller than that of the heating layer 20. Being in contact with ink, the cantilever 4 is covered with a thin insulating film (not shown). When the two heating portions of the cantilever 4 are supplied with current and generate heat, the cantilever 4 bends upward (toward the nozzle 3) as shown in FIG. 5C due to the difference in linear expansion coefficient between the heating layer 20 and the dielectric material layer 21. Thereby, the ink 7 in the liquid chamber 2 is discharged from the nozzle 3 in the form of a droplet 8.

U.S. Pat. No. 6,598,960 discloses a cantilever 4 including a dielectric material layer 21 sandwiched between two heating layers 20, 20. In this example, first, the upper heating layer 20 is supplied with current, and thereby the cantilever 4 is caused to bend away from the nozzle 3. Next, the lower heating layer 20 is supplied with current, and thereby the cantilever 4 is caused to bend toward the nozzle 3 as shown in FIG. 5C. Thus, a droplet can be discharged by a large driving force.

U.S. Pat. Appl. Pub. No. 2004/0036739 discloses a trapezoidal cantilever 4 in which the width of the fixed end 9 is greater than the width of the free end 10. This can also generate a large driving force and suitably discharge a droplet 8.

In general, in a discharging portion of a recording head using a thermo-mechanical actuator, a cantilever serving as a thermo-mechanical actuator is repeatedly heated and cooled. Thereby, minute bubbles are generated. These bubbles gather together and accumulate in the form of large bubbles in the liquid chamber. In addition, since moisture in the ink evaporates due to heat through the nozzle, the ink is thickened. This hinders stable discharge. In order to prevent these bad effects, a pump (not shown) provided in the printer suctions ink through the nozzle and thereby removes the bubbles and refreshes the thickened ink.

However, in the above-described thermo-mechanical actuator, in order to sufficiently remove the bubbles and the thickened ink, it is necessary to exert a high suction pressure. If such a high suction pressure is exerted, as shown in FIG. 6, the free end 10 of the cantilever 4 serving as a thermo-mechanical actuator is displaced by the flow of the suctioned ink 7 and blocks the nozzle 3. In this state, if the suction is continued, the ink 7 cannot be suctioned. Therefore, the bubbles cannot be sufficiently removed. In addition, the thickened ink cannot be sufficiently refreshed.

SUMMARY OF THE INVENTION

The present invention is directed to a recording head with improved maintainability in which the nozzle is not blocked even if a high pressure is exerted at the time of suction, and the bubbles and the thickened ink can be stably removed from the liquid chamber.

According to an aspect of the present invention, a recording head configured to discharge ink from a nozzle includes a cantilever and a liquid chamber. The cantilever has a free end and a fixed end and bends to generate a pressure for discharging ink. The liquid chamber communicates with the nozzle. The cantilever is disposed in the liquid chamber. The cantilever has a stepped portion on or in a surface facing the nozzle and in the vicinity of the free end.

According to an embodiment of the present invention, even if ink is suctioned with a high suction pressure through the nozzle at the time of maintenance, a space is formed between the free end of the cantilever serving as a thermo-mechanical actuator and the inner wall of the liquid chamber in the vicinity of the nozzle. That is to say, even if the free end of the cantilever is displaced toward the nozzle by a high suction pressure, the free end of the cantilever does not block the nozzle. Therefore, a high suction pressure can be exerted on the liquid chamber, and thereby the bubbles accumulated in the liquid chamber and the thickened ink can be completely removed.

Further features of the present invention will become apparent from the following description of exemplary embodiments with reference to the attached drawings.

DESCRIPTION OF THE EMBODIMENTS

First Embodiment

Figure 1A:
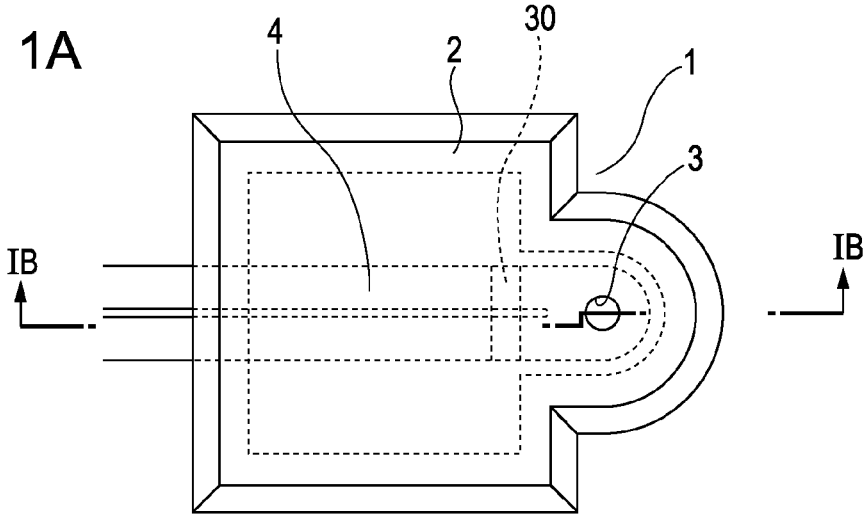
FIG. 1A is a top plan view of a discharging portion of a recording head according to a first embodiment of the present invention.
Figure 1B:
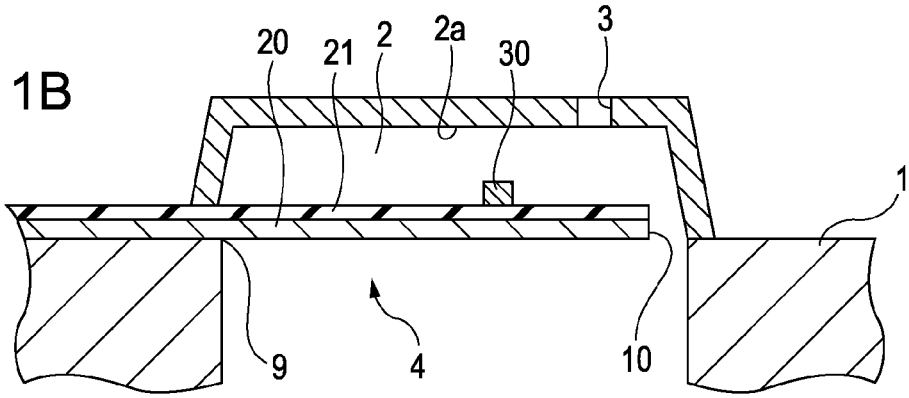
FIG. 1B is a sectional view taken along line IB-IB of FIG. 1A.
Figure 1C:
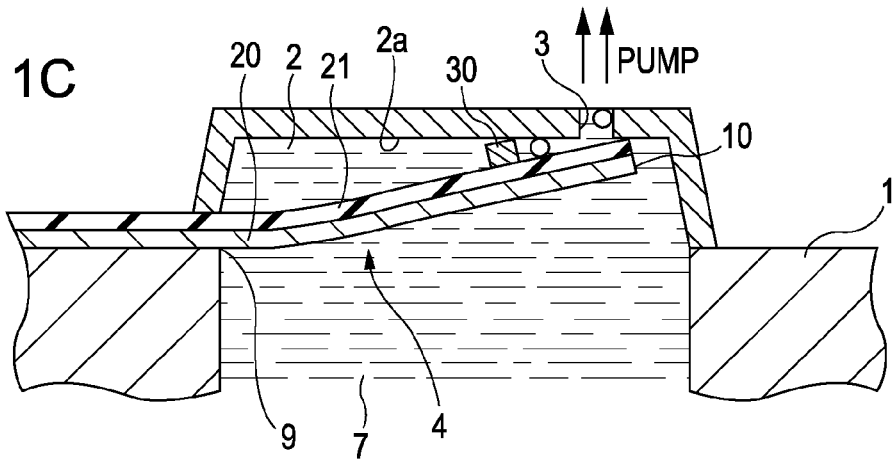
FIG. 1C shows a state in which ink is suctioned from the liquid chamber of the discharging portion.
Figure 5A:
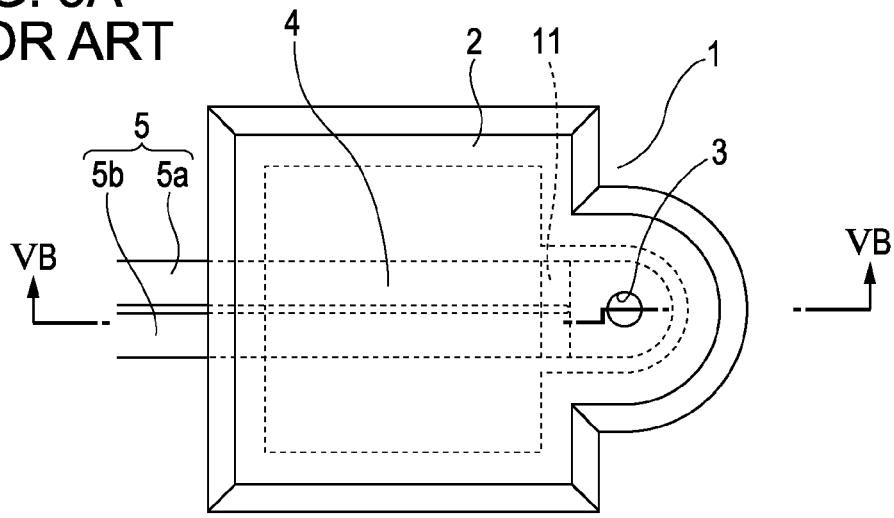
FIG. 5A PRIOR ART
FIG. 5A is a top plan view of a discharging portion of a conventional recording head using a thermo-mechanical actuator.
Figure 5B:
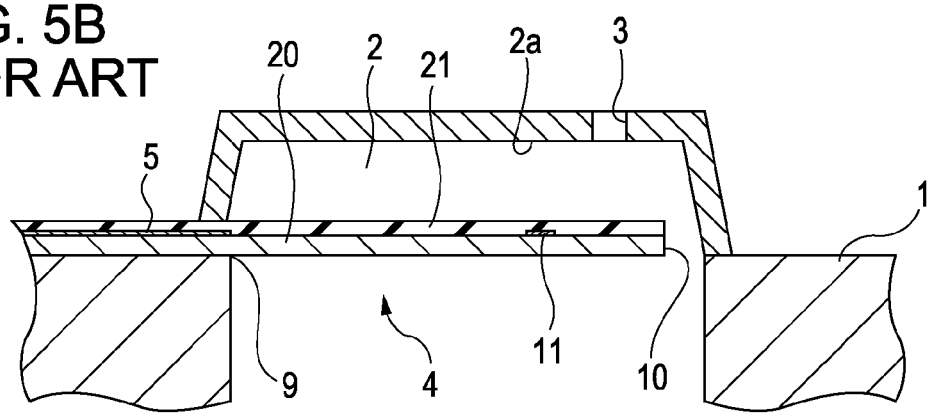
FIG. 5B PRIOR ART
FIG. 5B is a sectional view taken along line VB-VB of FIG. 5A.
Figure 5C:
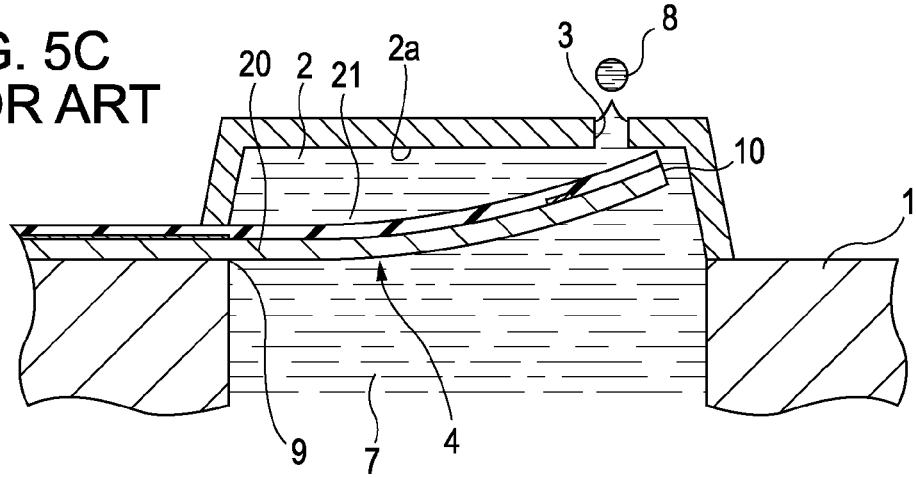
FIG. 5C PRIOR ART
FIG. 5C illustrates a state in which a droplet is being discharged from the discharging portion.
Figure 6:
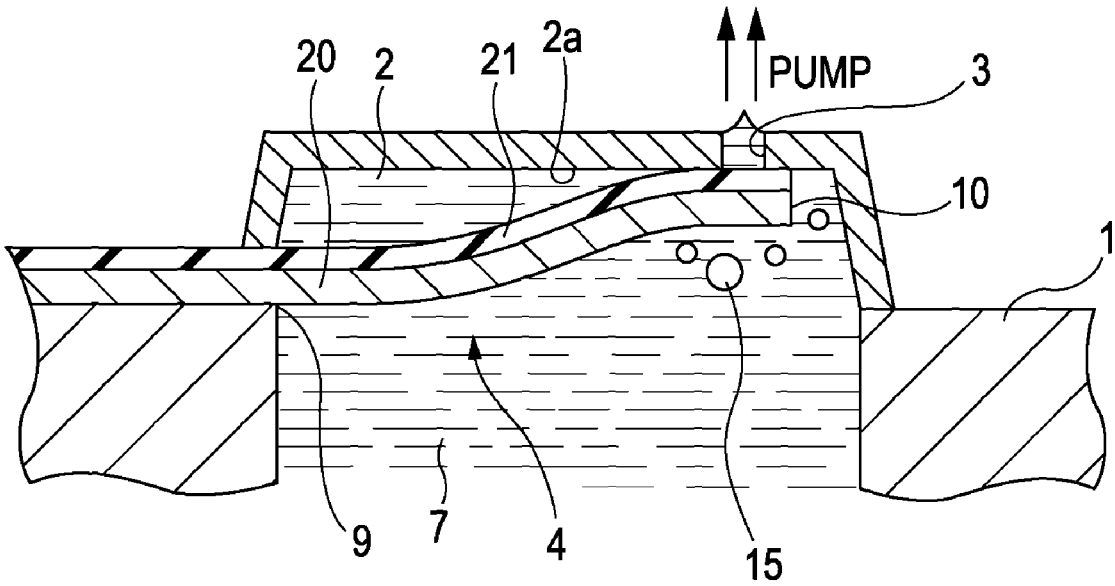
FIG. 6 PRIOR ART
FIG. 6 shows a state in which ink is suctioned from the liquid chamber of the discharging portion of the conventional recording head shown in FIGS. 5A to 5C.

FIGS. 1A to 1C show a first embodiment of the present invention. FIG. 1A is a top plan view of a discharging portion of a recording head. FIG. 1B is a sectional view taken along line IB-IB of FIG. 1A. FIG. 1C shows a state in which ink is suctioned from the liquid chamber of the discharging portion. The discharging portion in this embodiment has substantially the same structure as the conventional example shown in FIGS. 5A and 5B, except for the structure of the cantilever 4. A brief description will be made below with reference to FIGS. 1A and 1B.

The discharging portion includes a silicon substrate 1 and a liquid chamber 2 formed above the silicon substrate 1. The liquid (hereinafter referred to as "ink") in the liquid chamber 2 is discharged from a nozzle 3. A cantilever (thermo-mechanical actuator) 4, which is supported by the silicon substrate 1, extends in the liquid chamber 2. The cantilever 4 includes a heating layer (first layer) 20, a conductor layer, and a dielectric material layer (second layer) 21. The heating layer 20 is divided into two heating portions by a slit. The conductor layer forms an interconnect portion 5 that supplies current to the two heating portions, and an electrode that connects the two heating portions. The heating layer (first layer) 20 is formed of a resistor. The dielectric material layer (second layer) 21 is formed of an insulator. As shown in FIG. 1B, the dielectric material layer (second layer) 21 is superposed on the upper surface of the heating layer (first layer) 20, that is to say, on the discharging side (nozzle side) of the heating layer 20. In order to cause the cantilever (thermo-mechanical actuator) 4 to bend, the linear expansion coefficient of the dielectric material layer (second layer) 21 is sufficiently smaller than that of the heating layer (first layer) 20.

The cantilever (thermo-mechanical actuator) 4 in this embodiment has a protrusion 30 superposed on the upper surface of the dielectric material layer (second layer) 21 so that a stepped portion is formed on the dielectric material layer 21 (see FIG. 1B). That is to say, the protrusion 30 is provided on the nozzle-side surface of the cantilever 4 near the free end 10. The protrusion 30 is provided on the upper surface of the cantilever 4 nearer the fixed end 9 in relation to the nozzle 3 so as not to block the nozzle (ink discharging port) 3. As shown in FIG. 1A, the protrusion 30 is provided on the upper surface of the dielectric material layer (second layer) 21 in the form of a band extending across the dielectric material layer 21. However, the present invention is not limited to this. For example, the protrusion 30 may be cylindrical or conical. Since the protrusion 30 is superposed on the upper surface of the dielectric material layer 21 formed of an insulator, various materials such as resin and metal can be used for forming the protrusion 30 as long as they are ink-resistant.

The operation of the cantilever 4 having such a structure and serving as a thermo-mechanical actuator in the discharging portion will be described with reference to FIG. 1C.

As shown in FIG. 1C, in order to remove the bubbles and the thickened ink in the liquid chamber 2, a pump provided in the printer body suctions the ink 7 in the liquid chamber 2 through the nozzle 3 with a high pressure. At this time, even if the free end 10 of the cantilever 4 is displaced by the flow of the suctioned ink 7, the protrusion 30 comes into contact with the ceiling 2*a* of the liquid chamber 2. Thereby, the displacement of the free end 10 of the cantilever 4 is restricted, and the free end 10 of the cantilever 4 does not block the nozzle 3. That is to say, since the protrusion 30 is provided on the upper surface of the cantilever 4, at the time of suction, even if the free end 10 of the cantilever 4 is displaced toward the nozzle 3, a space through which the bubbles and the ink 7 can pass always exists between the cantilever 4 and the nozzle 3. Therefore, at the time of suction, the bubbles and the thickened ink can be stably removed from the liquid chamber 2.

Second Embodiment

Figure 2A:
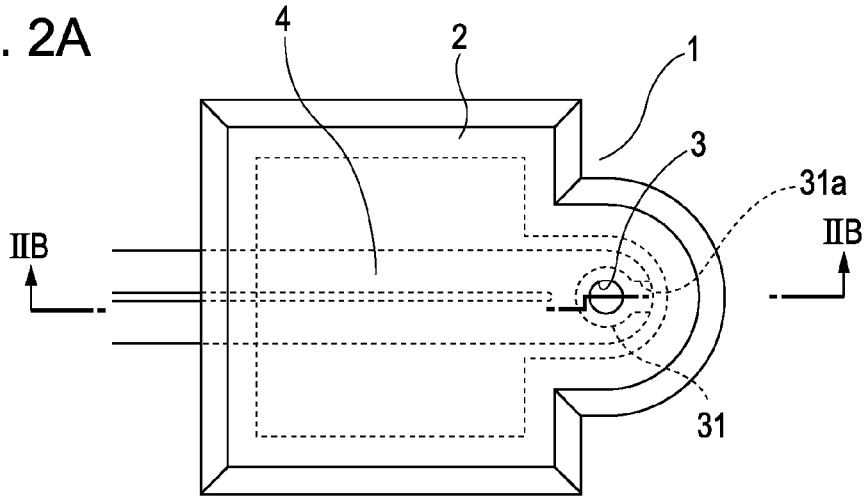
FIG. 2A is a top plan view of a discharging portion of a recording head according to a second embodiment of the present invention.
Figure 2B:
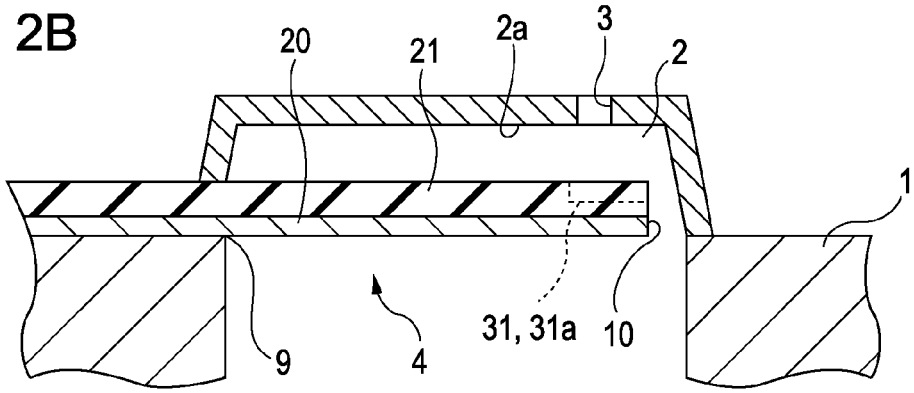
FIG. 2B is a sectional view taken along line IIB-IIB of FIG. 2A.
Figure 2C:
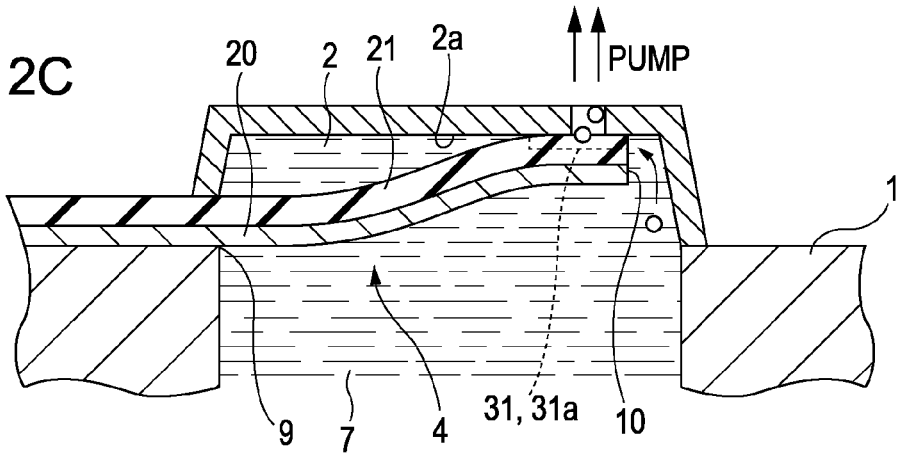
FIG. 2C shows a state in which ink is suctioned from the liquid chamber of the discharging portion.

FIGS. 2A to 2C show a second embodiment of the present invention. FIG. 2A is a top plan view of a discharging portion of a recording head. FIG. 2B is a sectional view taken along line IIB-IIB of FIG. 2A. FIG. 2C shows a state in which ink is suctioned from the liquid chamber of the discharging portion. The discharging portion in this embodiment has substantially the same structure as the first embodiment, except for the cantilever 4.

The cantilever (thermo-mechanical actuator) 4 in this embodiment has a depression 31 formed in the upper surface of the dielectric material layer (second layer) 21 so as to form a stepped portion in the dielectric material layer 21 (see FIG. 2B). The depression 31 is opposite the nozzle 3 and is open upward in FIG. 2B, that is to say, toward the nozzle (ink discharging port) 3. In other words, the depression 31 is formed in the droplet-discharging-side (nozzle-side) surface of the cantilever 4.

In this embodiment, the cross-sectional shape of the depression 31 is a circle that is similar to the cross-sectional shape of the nozzle 3 and is slightly larger than the cross-sectional shape of the nozzle 3. The shape of the depression 31 is not necessarily circular. The depression 31 can have any shape as long as its cross-sectional shape is larger than the cross-sectional shape of the nozzle 3. As shown in FIG. 2A, the depression 31 is also open at the free end 10 of the cantilever 4 toward the liquid chamber 2 via a groove 31*a* that has the same depth as the depression 31 and is open upward. Alternatively, the depression 31 may be open at both sides (the upper and lower edges in FIG. 2A) of the cantilever 4 toward the liquid chamber 2 via grooves.

Since the depression 31 and the groove 31*a* are provided, even if the cantilever 4 is displaced so as to block the nozzle 3, the depression 31 and the groove 31*a* form a liquid flow path communicating between the nozzle 3 and the liquid chamber 2, and the flow of bubbles and ink is not blocked.

The operation of the cantilever 4 having such a structure and serving as a thermo-mechanical actuator in the discharging portion will be described with reference to FIG. 2C.

As shown in FIG. 2C, in order to remove the bubbles and the thickened ink in the liquid chamber 2, a pump provided in the printer body suctions the ink 7 in the liquid chamber 2 through the nozzle 3 with a high pressure. At this time, even if the free end 10 of the cantilever 4 is displaced by the flow of the suctioned ink and the free end 10 comes into contact with the ceiling 2*a* of the liquid chamber 2, the free end 10 of the cantilever 4 does not block the nozzle 3 as described above. That is to say, since the depression 31 and the groove 31*a* communicating between the nozzle 3 and the liquid chamber 2 are provided, as in the first embodiment, a space through which the bubbles and the ink 7 can pass always exists between the cantilever 4 and the nozzle 3. Therefore, at the time of suction, the bubbles and the thickened ink can be stably removed from the liquid chamber 2.

Third Embodiment

Figure 3A:
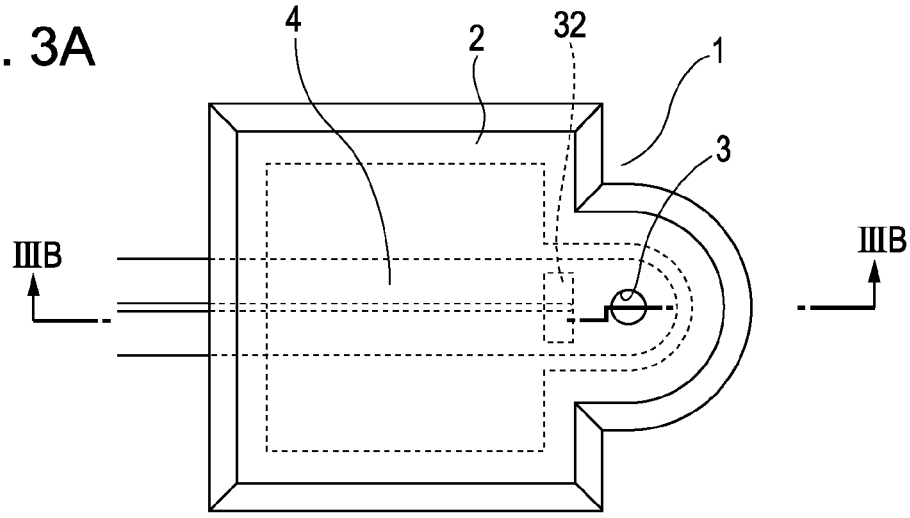
FIG. 3A is a top plan view of a discharging portion of a recording head according to a third embodiment of the present invention.
Figure 3B:
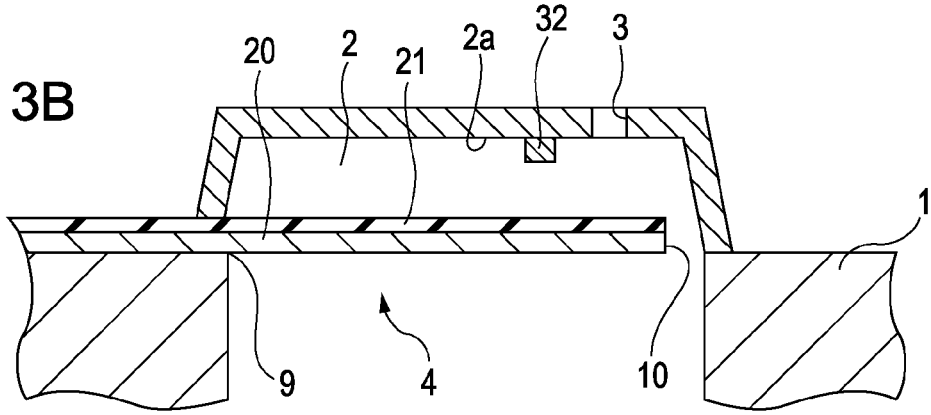
FIG. 3B is a sectional view taken along line IIIB-IIIB of FIG. 3A.
Figure 3C:
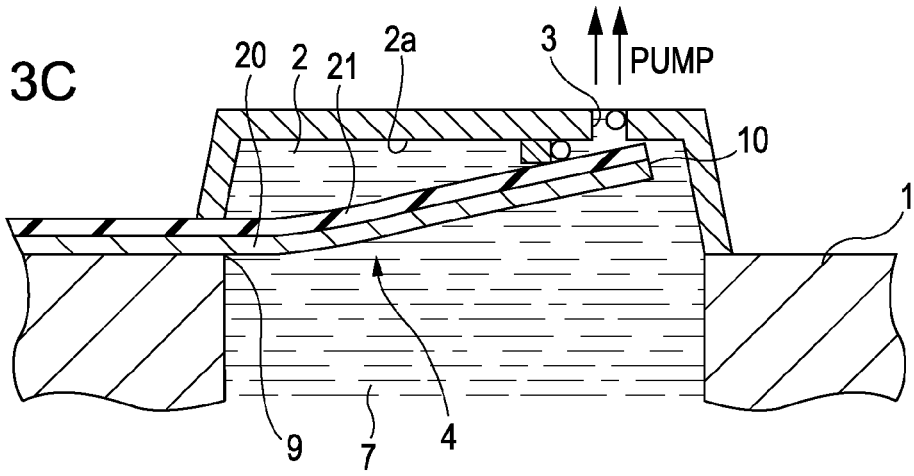
FIG. 3C shows a state in which ink is suctioned from the liquid chamber of the discharging portion.

FIGS. 3A to 3C show a third embodiment of the present invention. FIG. 3A is a top plan view of a discharging portion of a recording head. FIG. 3B is a sectional view taken along line IIIB-IIIB of FIG. 3A. FIG. 3C shows a state in which ink is suctioned from the liquid chamber of the discharging portion. The discharging portion in this embodiment has substantially the same structure as the first embodiment, except that a protrusion 32 is provided on the ceiling 2*a* of the liquid chamber 2 instead of being provided on the upper surface of the cantilever 4.

In this embodiment, the protrusion 32 is superposed on the ceiling 2*a* that defines the liquid chamber 2 and in which the nozzle (ink discharging port) 3 is formed, so as to form a stepped portion on the ceiling 2*a*. In other words, the protrusion 32 is formed so as to protrude from the ceiling 2*a* into the liquid chamber 2. The protrusion 32 is formed nearer the fixed end 9 of the cantilever 4 in relation to the nozzle 3 so as not to block the nozzle 3. The protrusion 32 may be in the form of a band extending across the cantilever 4 as in the first embodiment, or cylindrical. The protrusion 32 may be formed of any material, for example, resin or metal.

Since the discharging portion has such a structure, at the time of suction, even if the free end 10 of the cantilever 4 is displaced by the flow of the suctioned ink 7, the protrusion 32 comes into contact with the upper surface of the cantilever 4. Thereby, as shown in FIG. 3C, also in this embodiment, the displacement of the free end 10 of the cantilever 4 is restricted, and the free end 10 of the cantilever 4 does not block the nozzle 3. That is to say, at the time of suction, even if the free end 10 of the cantilever 4 is displaced toward the nozzle 3, a space through which the bubbles and the ink 7 can pass always exists between the cantilever 4 and the nozzle 3. Therefore, as in the first embodiment, also in this embodiment, at the time of suction, the bubbles and the thickened ink can be stably removed from the liquid chamber 2.

Fourth Embodiment

Figure 4A:
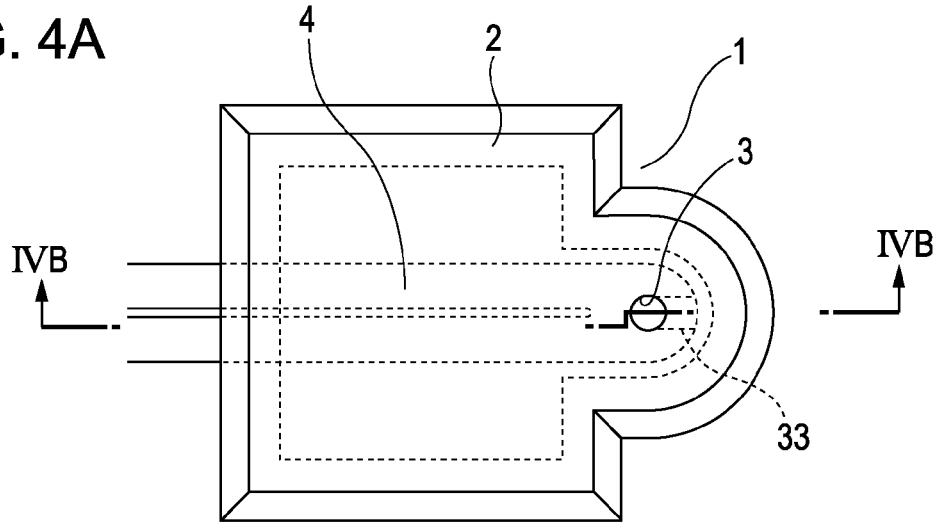
FIG. 4A is a top plan view of a discharging portion of a recording head according to a fourth embodiment of the present invention.
Figure 4B:
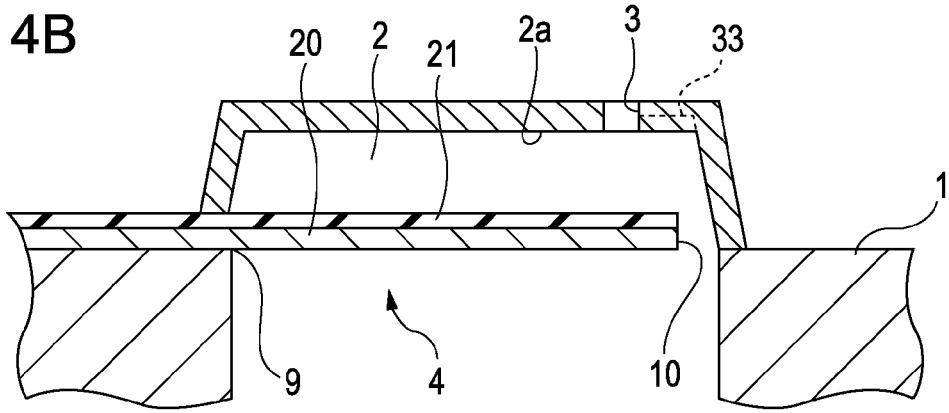
FIG. 4B is a sectional view taken along line IVB-IVB of FIG. 4A.
Figure 4C:
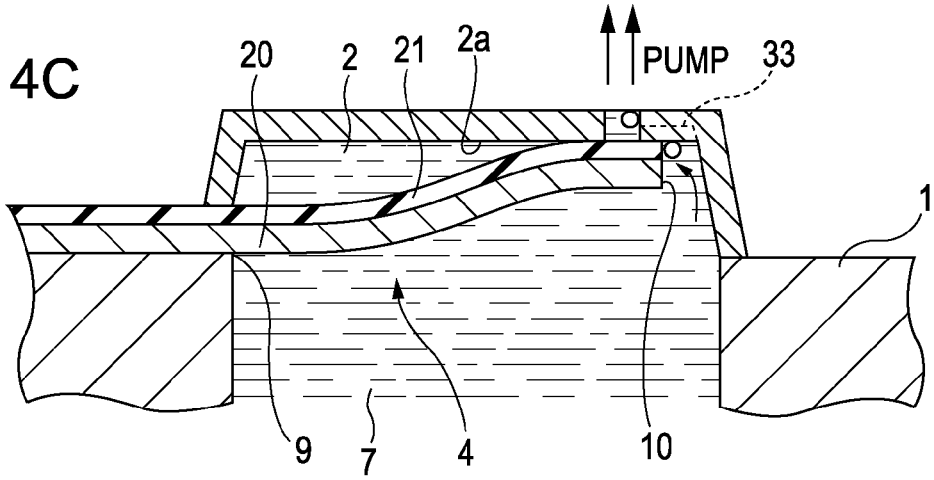
FIG. 4C shows a state in which ink is suctioned from the liquid chamber of the discharging portion.

FIGS. 4A to 4C show a fourth embodiment of the present invention. FIG. 4A is a top plan view of a discharging portion of a recording head. FIG. 4B is a sectional view taken along line IVB-IVB of FIG. 4A. FIG. 4C shows a state in which ink is suctioned from the liquid chamber of the discharging portion. The discharging portion in this embodiment has a groove 33 that is formed in the ceiling 2*a* defining the liquid chamber 2 so as to form a stepped portion in the ceiling 2*a* (see FIG. 4B). The discharging portion in this embodiment has the same structure as the second embodiment except for this point. The groove 33 is open downward (toward the liquid chamber 2) and toward the nozzle 3. That is to say, the groove 33 is formed in the ceiling 2*a* defining the liquid chamber 2.

The groove 33 extends outward beyond the region where the cantilever 4 is in contact with the ceiling 2*a*. In this embodiment, as shown in FIGS. 4A and 4B, the groove 33 extends to the right-hand (in the figures) side wall adjacent to the ceiling. However, the present invention is not limited to this. Grooves may extend to the upper and lower (in FIG. 4A) side walls.

Since such groove 33 is formed in the ceiling 2*a*, even if the cantilever 4 blocks the nozzle 3, a path communicating between the nozzle 3 and the liquid chamber 2 is formed, and the flow of bubbles and ink is not blocked.

Therefore, also in this embodiment, at the time of suction, even if the free end 10 of the cantilever 4 is displaced by the flow of the suctioned ink 7 and blocks the nozzle 3, the communication between the nozzle 3 and the liquid chamber 2 is maintained as shown in FIG. 4C. In other words, at the time of suction, even if the free end 10 of the cantilever 4 is displaced toward the nozzle 3, a space through which the bubbles and the ink 7 can pass always exists between the cantilever 4 and the nozzle 3. Therefore, as in the above-described embodiments, also in this embodiment, at the time of suction, the bubbles and the thickened ink can be stably removed from the liquid chamber 2.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-232472 filed Aug. 29, 2006, which is hereby incorporated by reference herein in its entirety.

What is claimed is:

1. A recording head configured to discharge ink from a nozzle, the recording head comprising:

a cantilever having a free end and a fixed end, the cantilever configured to bend to generate a pressure for discharging ink;

a liquid chamber communicating with the nozzle, the cantilever being disposed in the liquid chamber; and a wall portion defining the liquid chamber and having the nozzle, wherein the wall portion has a stepped portion on or in an inner surface and in the vicinity of the nozzle, and wherein the stepped portion is formed by a depression in the inner surface of the wall portion.

* * * * *